US008844085B2

(12) United States Patent
Bruckner et al.

(10) Patent No.: US 8,844,085 B2
(45) **Date of Patent: *Sep. 30, 2014**

(54) BRIDGE CAP INSTALLATION SYSTEM AND METHOD

(71) Applicant: Union Pacific Railroad Company, Omaha, NE (US)

(72) Inventors: Michael A. Bruckner, Omaha, NE (US); Troy N. James, Jr., Rison, AR (US); Butch Lunsford, Rison, AR (US)

(73) Assignee: Union Pacific Railroad Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/099,579

(22) Filed: Dec. 6, 2013

(65) Prior Publication Data

US 2014/0165305 A1 Jun. 19, 2014

Related U.S. Application Data

(63) Continuation of application No. 13/423,944, filed on Mar. 19, 2012, now Pat. No. 8,621,697.

(51) Int. Cl.

| | |
|---|---|
| ***E01D 21/00*** | (2006.01) |
| ***E04G 21/14*** | (2006.01) |
| ***E01D 19/00*** | (2006.01) |
| ***B66C 1/22*** | (2006.01) |
| ***E01D 22/00*** | (2006.01) |

(52) U.S. Cl.

CPC ..... *E01D 22/00* (2013.01); *E01D 19/00* (2013.01); *B66C 1/22* (2013.01)

USPC ..... 14/77.1; 414/10; 414/12

(58) Field of Classification Search

USPC ..... 414/10, 11, 12; 14/77.1

IPC ..... E01D 21/00,21/06, 21/10; E04G 21/14, E04G 21/16

See application file for complete search history.

(56) References Cited

U.S. PATENT DOCUMENTS

| | | | |
|---|---|---|---|
| 3,318,467 | A | 5/1967 | Frantz |
| 3,571,835 | A | 3/1971 | Buechler |
| 3,985,480 | A | 10/1976 | Finsterwalder |
| 4,103,861 | A | 8/1978 | Buchler et al. |

(Continued)

OTHER PUBLICATIONS

C Hooks—Below-the-Hook—Bushman Equipment, Inc.; http://www.bushman.com/index.php/content/below_the_hook/c_hooks, Copyright 2012, 7 pages.

*Primary Examiner* — Gary Hartmann

(74) *Attorney, Agent, or Firm* — Pillsbury Winthrop Shaw Pittman, LLP

(57) ABSTRACT

A lifting device is configured to support a bridge cap when lifting the cap onto columns under a bridge deck. The lifting device includes an upper bracket arm configured to extend over an upper surface of the deck, and a lower bracket arm configured to extend under a bottom surface of the deck, and to selectively engage the cap. A side bracket portion connects the lower and upper arms, and is configured to transmit a force associated with a weight of the cap to the upper arm. The upper and lower arms and the side bracket portion are configured to define an open space extending from free ends of the upper and lower arms to the side bracket portion. The space is configured to receive the deck when the lifting device is supporting the cap as the cap is being lifted onto the columns.

15 Claims, 5 Drawing Sheets

(56) References Cited

U.S. PATENT DOCUMENTS

| | | | | |
|---|---|---|---|---|
| 4,282,978 | A | 8/1981 | Zambon | |
| 4,714,393 | A | 12/1987 | Betts | |
| 5,076,448 | A | 12/1991 | Ballard | |
| 6,701,564 | B2 | 3/2004 | Snead | |
| 7,013,520 | B1 | 3/2006 | Snead | |
| 7,363,671 | B2 | 4/2008 | Snead | |
| 8,136,191 | B2 | 3/2012 | Jorkama-Lopez et al. | |
| 8,166,596 | B2 | 5/2012 | Kang et al. | |
| 8,621,697 | B2 * | 1/2014 | Bruckner et al. | 14/77.1 |
| 2011/0067955 | A1 | 3/2011 | Jorkama-Lopez et al. | |

* cited by examiner

BRIDGE CAP INSTALLATION SYSTEM AND METHOD

This application is a continuation of U.S. patent application Ser. No. 13/423,944, now U.S. Pat. No. 8,621,697, entitled "Bridge Cap Installation System and Method," filed Mar. 19, 2012, which is hereby incorporated herein by reference in its entirety.

BACKGROUND

1. Field

The present disclosure is generally related to bridge upgrades and replacement, and in particular to replacement of a bridge cap without or prior to alteration or replacement of a bridge deck.

2. Description of Related Art

It may be desirable to repair or replace a bridge without rerouting the traffic that frequently traverses it. For example, railroad bridges typically carry regular freight or passenger traffic which cannot be easily or cheaply rerouted. As such, repair or replacement of such bridges is preferably conducted in a manner that would have minimal disruption to the bridge deck. For example, by installing new columns and bridge caps adjacent to old (i.e. preexisting) columns and bridge caps, the old columns and bridge caps may become redundant to supporting the bridge deck and beams, and may subsequently be removed. Alternatively, the columns and/or caps may be replaced individually, one at a time. Throughout this process, traffic may traverse the bridge deck unimpeded. Once an entire set of new columns and bridge caps are in place, the bridge deck and the support beams may be quickly replaced.

Conventionally, the process of replacing a bridge cap without disturbing the bridge deck and beams is a multi-step process, requiring repeated engagements between a lifting apparatus and the bridge cap that is being lifted into place. For example, in some conventional configurations, such as that described in U.S. Pat. No. 7,363,671, the lifting apparatus may need to be repeatedly adjusted as the bridge cap is slid between the beams and the new columns. For example, in that configuration, multiple lift rods are configured to selectively engage or disengage the bridge cap, by extending through the bridge deck in spacings between the bridge beams. The bridge cap is then slid until an engaging one of the lift rods moves adjacent to one of the bridge beams, at which time a disengaged lift rod is moved through a different spacing between the bridge beams to assist in supporting the bridge cap, while the lift rod that is adjacent to the bridge beam is disengaged. The sliding movement of the bridge cap then may continue, with the repeated engagement and disengagement of the lift rods between the bridge beams, until the bridge cap is supported on both sides of the bridge beams and bridge deck, to lift the bridge cap into final position on the columns.

It may be appreciated that each engagement and disengagement of the bridge cap (i.e. through the lift rods extending between the bridge beams and bridge deck) is potentially hazardous to field personnel and other workers assisting the lift, as they must be in close proximity to the lifted bridge cap to position and engage the lift rods, or other support structures. Additionally, the bridge deck must often be modified so as to expose the spacing between the bridge beams, to allow for the progressive and gradual movement of the new bridge cap onto the associated columns. Furthermore, with each engagement between spaces of the bridge beams, a potential of accidently impacting the bridge beam is increased.

SUMMARY

According to an embodiment, a lifting device is configured to support a bridge cap when lifting the bridge cap onto columns under a bridge deck. The lifting device includes an upper bracket arm configured to extend over an upper surface of the bridge deck. The lifting device also includes a lower bracket arm configured to extend under a bottom surface of the bridge deck, and to selectively engage the bridge cap. The lifting device further includes a side bracket portion connecting the lower bracket arm and the upper bracket arm. The side bracket portion is configured to transmit a force associated with a weight of the bridge cap to the upper bracket arm. The upper bracket arm, the lower bracket arm, and the side bracket portion are configured to define an open space extending from free ends of the upper bracket arm and the lower bracket arm to the side bracket portion. The open space is configured to receive the bridge deck when the lifting device is supporting the bridge cap as the bridge cap is being lifted onto the columns.

According to another embodiment, an assembly includes a bridge having a bridge deck, a support column spaced beneath the bridge deck, the support column configured to receive a bridge cap thereon, and a lifting device. The lifting device includes an upper bracket arm configured to extend over an upper surface of the bridge deck, a lower bracket arm configured to extend under a bottom surface of the bridge deck, and to selectively engage the bridge cap, and a side bracket portion connecting the lower bracket arm and the upper bracket arm, the side bracket portion configured to transmit a force associated with a weight of the bridge cap to the upper bracket arm. The upper bracket arm, the lower bracket arm, and the side bracket portion are configured to define an open space extending from free ends of the upper bracket arm and the lower bracket arm to the side bracket portion. The open space is configured to selectively receive the bridge deck when the lifting device is lifting the bridge deck onto the support column.

Other features and advantages of the present disclosure will become apparent from the following detailed description, the accompanying drawings, and the appended claims.

DETAILED DESCRIPTION OF THE PREFERRED EMBODIMENT(S)

Figure 1:
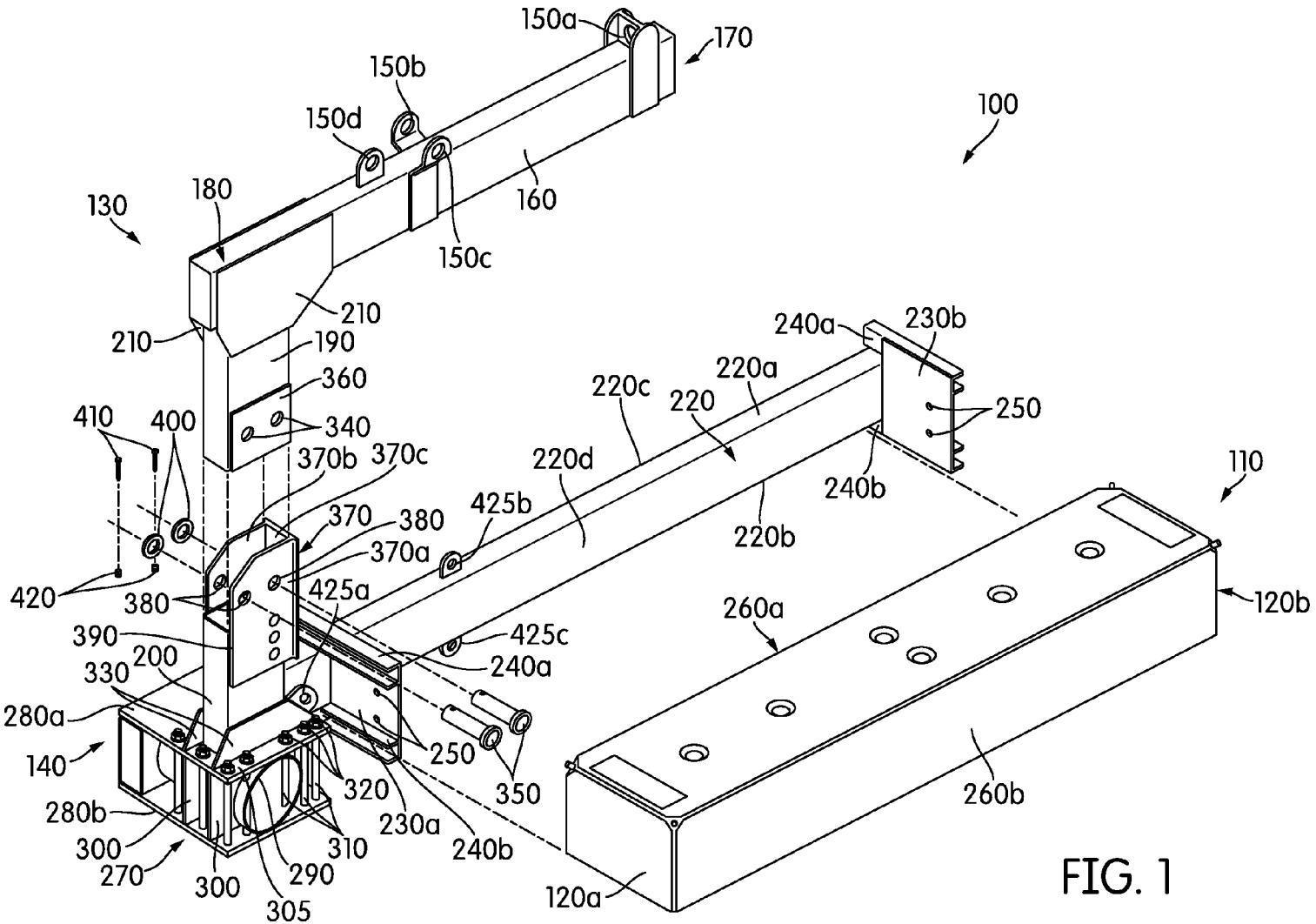
FIG. 1 illustrates a semi-exploded isometric view of a lifting device configured to support a bridge cap during a lift thereof.

FIG. 1 illustrates a lifting device 100 configured to engage a bridge cap 110, from opposing ends 120*a* and 120*b* of the bridge cap 110, so as to allow the bridge cap 110 to be lifted and installed on columns or piles installed underneath an existing bridge deck. In the illustrated embodiment, the lifting device 100 includes an upper bracket assembly 130 and a lower bracket assembly 140. In other embodiments, one or more components of the lifting device 100, including components characterized herein as being part of the upper bracket assembly 130 and the lower bracket assembly 140, may be integrally formed together.

In the illustrated embodiment, the upper bracket assembly 130 comprises an arm configured to couple to a hoist line or hook block of a crane, while the lower bracket assembly 140 comprises an arm configured to engage and support the bridge cap 110. As shown in the illustrated embodiment, the upper bracket assembly 130 includes one or more cable engaging supports 150 (e.g., hoist eyes) positioned along an upper beam 160. These cable engaging supports 150 may also be referred to as connectors or cable connectors. In the illustrated embodiment, the upper bracket assembly 130 includes cable engaging supports 150*a-d*, as described in greater detail below. In the illustrated embodiment, the cable engaging supports 150 include a hole configuration. In other embodiments, the cable engaging supports 150 may have a hook, bracket, or other appropriate coupling configuration. Additionally, while in some embodiments the cable or hook associated with the hoist line or hook block might selectively engage only one cable engaging support 150, in other embodiments where there are multiple cable engaging supports 150, the cable or hook of the hoist line or hook block may be coupled to multiple cable engaging supports 150. As described in greater detail below, certain ones of the cable engaging supports 150 may be utilized in particular configurations of the lifting device 100. For example, while the cable engaging support 150*a* may be located along the upper beam 160 at a position associated with the center of gravity of the lifting device 100 and the beam cap 110 together (i.e., vertically above the center of gravity in an upright orientation), another of the cable engaging supports 150 may be located along the upper beam 160 at a position associated with the center of gravity of the lifting device 100 in the absence of the beam cap 110.

As shown, the upper beam 160 is elongated, and contains a free end 170 and a connected end 180. The connected end 180 of the upper beam 160 couples to an upper side-beam 190. As described in greater detail below, the upper side-beam 190 is configured to extend from the upper beam 160 towards the lower bracket assembly 140. In particular, the upper side-beam 190 is configured to couple to a lower side-beam 200 of the lower lifting assembly 140, as described in greater detail below. It may be appreciated, however, that in some embodiments the upper side-beam 190 and the lower side-beam 200 may be replaced by a common side-beam, which may be one continuous piece. Generally the upper side-beam 190 and the lower side-beam 200 may together be of sufficient vertical length so that the upper beam 160 may extend over the top of a bridge deck, while the bridge cap 110 and the associated support structures of the lower bracket assembly 140 may extend under the bridge deck and associated bridge beams, when the bridge cap 110 is being moved laterally between the bridge beams and the columns that the bridge cap 110 will rest on. In some embodiments, an intermediate side-beam may couple between the upper side-beam 160 and the lower side-beam 200, so as to facilitate use of the lifting device 100 with a thicker bridge deck and associated bridge beams.

The attachment of the upper beam 160 and the upper side-beam 190 may vary across embodiments. For example, in the illustrated embodiment the upper beam 160 and the upper side-beam 190 are coupled through a pair of coupling plates 210 which may be welded across aligned faces of the upper beam 160 and the upper side-beam 190. In an embodiment, an engaging face of the upper side-beam 190 may also or alternatively be welded onto the underside of the upper beam 160. It may be appreciated that other connections may also or alternatively be provided, including but not limited to rivets, pins, bolts, and hooks. Additionally, as noted above, in some embodiments the upper side-beam 190 may be integrally formed with the upper beam 160.

As shown in FIG. 1, the lower bracket assembly 140 includes a lower beam 220 that is configured to extend alongside the bridge cap 110, configured to support the weight of the bridge cap 110. In an embodiment the lower beam 220 may have sufficient length to enable cap supports 230 (individually cap supports 230*a* and 230*b*) to engage the ends 120*a* and 120*b*. As one non-limiting example, in an embodiment wherein the bridge cap 110 is approximately 15 feet long, the lower beam 220 may be approximately 20 feet long. In the illustrated embodiment, cap support 230*a* is mounted to the lower beam 220 to receive the end 120*a* of the bridge cap 110, while cap support 230*b* is mounted to the lower beam 220 to receive the end 120*b* of the bridge cap 110. In an embodiment, each of the cap supports 230 are coupled to the lower beam 220 via mounting beams 240*a* that engage a top 220*a* of the lower beam 220, and mounting beams 240*b* that engage a bottom 220*b* of the lower beam 220. In various embodiments the coupling therebetween may be via welding, bolts, rivets, pins, or by any other appropriate connection. In an embodiment, a back support structure may be welded between the mounting beam 240*a* and the mounting beam 240*b* on a back side 220*c* of the lower beam 220 opposite a cap facing side 220*d* of the lower beam 220, so as to provide additional support for the cap supports 230. In an embodiment, either or both of the cap supports 230 may be adjustably mounted on the lower beam 220, so as to allow for connection to differing lengths of bridge caps 110. It may be appreciated that such adjustment may be facilitated by any appropriate engagement mechanism, including but not limited to support bolts being driven through the mounting beams 240*a* into apertures associated with different lengths of the bridge cap 110. In an embodiment, the cap supports 230 may be mounted on the lower beam 220 so as to provide a space therebetween sufficient to receive a largest standard size of bridge cap 110. In such an embodiment, spacers may be positioned between each end 120*a*, 120*b* and the associated cap support 230*a*, 230*b*, so as to securely hold the bridge cap 110 between the cap supports 230. As indicated above, in embodiments where the lifting device 100 is configured to receive differing lengths of bridge caps 110, adjustment of the position of the cable engaging support 150*a* may facilitate balancing the weight of the lifting device 100 and the bridge cap 110, to support them from above a combined center of gravity thereof.

The cap supports 230 may engage the bridge cap 110 in a supportive manner through any appropriate mechanism. In some embodiments, weld plates may be fixed to or otherwise formed in the ends 120*a* and 120*b*, and may be welded to (and subsequently cut from) the cap supports 230 to support the weight of the bridge cap 110. In the illustrated embodiment, apertures 250 are formed in the cap supports 230. Bolts or other fasteners may selectively extend through the apertures 250 into the ends 120*a*, 120*b* of the bridge cap 110 to support the bridge cap 110 from within. In some embodiments, the bolts or other fasteners that extend through the apertures 250 may be of sufficient strength such that a single bolt associated with cap support 230*a* and a single bolt associated with cap support 230*b* may fix the bridge cap 110 relative to the lower bracket assembly 140. In the illustrated embodiment, a pair of apertures 250 is associated with each of the cap supports 230*a* and 230*b*, which may distribute the weight of the bridge cap 110, prevent pivoting thereof, and so on. In other embodiments, additional apertures 250 configured to receive additional bolts or other fasteners may also be formed in each of the cap supports 230*a* and 230*b*. It may be appreciated that once the bridge cap 110 is placed on the bridge columns, as described in greater detail below, the bolts or other fasteners may be withdrawn from the bridge cap 110, so that the bridge cap 110 may be supported by the columns, while the lifting device 100 may move relative to the bridge cap 110, for removal thereof.

Although not shown in the illustrated embodiment in some embodiments, a support ledge may additionally or alternatively be formed at the bottom of each of the cap supports 230*a* and 230*b*, configured to support the bridge cap 110 from the bottom of the bridge cap 110, adjacent to the ends 120*a* and 120*b*. While such an embodiment might not be preferred, as it may be difficult to position the support ledge underneath the bridge cap 110 so as to lift the bridge cap 110, such support ledges may be more useful where the bridge cap 110 is formed to contain raised supporting portions that may engage such support ledges, to assist in the lift of the bridge cap 110. In an embodiment containing support ledges, it may be appreciated that an open space between the support ledges of the cap supports 230*a* and 230*b* may allow the bridge cap 110 to engage the columns associated therewith. Accordingly, the lifting device 100 may then be lowered slightly, so that the bridge cap 110 is supported by the columns instead of the support ledges, before the lifting device is removed.

As shown in the embodiment of FIG. 1, the cap supports 230*a* and 230*b*, together with the lower beam 220, may form a generally U-shaped receiving space configured to envelop the ends 120*a* and 120*b*, as well as a longitudinal side 260*a*, leaving at least a longitudinal side 260*b* of the bridge cap 110 unobstructed, which may facilitate removal of the lifting device 100 from the bridge cap 110 when the bridge cap 110 is installed on the columns. In embodiments utilizing a single bolt or fastener through an associated aperture 250 in the cap supports 230*a* and 230*b*, a cap facing side 220*d* of the lower beam 220 may prevent pivoting of the bridge cap about an axis established by the bolt or fastener through each cap support 230*a* and 230*b*. In other embodiments utilizing a single bolt or fastener through an associated aperture 250 in each of the cap supports 230*a* and 230*b*, the bolt or fastener associated with each cap support 230*a* and 230*b* may be offset from one another, so as to not define a single axis, which may prevent pivotal movement thereabout. It may be appreciated that in some embodiments the bridge cap 110 may be coupled to the lower beam 220 at the longitudinal side 260*a*, which may also prevent pivotal movement of the bridge cap 110.

It may be appreciated that balancing the weight of the bridge cap 110 during a lift may be important to the structural stability of the lifting device 100, and may simplify movement of the lifting device 100 and the bridge cap 110. As shown in the illustrated embodiment, the lower bracket assembly 140 may be configured to mount to the upper bracket assembly 130 so that the upper beam 160 extends generally above and parallel to the bridge cap 110. In the illustrated embodiment, the upper beam 160 is configured to extend above a center of gravity of the combination of the lifting device 100 and the bridge cap 110 in a longitudinal direction, so that the cable engaging support 150*a*, centered in a lateral direction on the upper beam 160 may support the lifting device 100 and the bridge cap 110 without the assembly tipping forward or backward (i.e, pivoting about either of the longitudinal sides 260*a* or 260*b*). While in some embodiments the upper beam 160 may be centered over the bridge cap 110, in other embodiments the upper beam 160 may extend over a weighted center between the bridge cap 110 and the lower bracket assembly 140. Other positions of the upper beam 160 relative to the lower beam 220 are also possible.

Additionally, it may be appreciated that one or more of the cable engaging supports 150 may be positioned on the upper beam 160 so as to approximately balance the weight of the lifting device 100 and the bridge cap 110 across the length of the lifting device 100 and the bridge cap 110. For example, while in some embodiments at least one of the cable engaging supports 150 may be centered over the bridge cap 110 in a direction of elongation thereof, in other embodiments at least one of the cable engaging supports 150 may be positioned at a joint center of gravity for the lifting device 100 and the bridge cap 110 in either or both of the lateral and longitudinal directions. In an embodiment, one of the cable engaging supports 150 may be positioned above a center of gravity for the lifting device 100 alone, and may be utilized instead of the cable engaging support 150 positioned above the center of gravity for the lifting device 100 and the bridge cap 110 once the bridge cap 110 is separated from the lifting device 100. In the illustrated embodiment, the cable engaging support 150*a* is positioned above the center of gravity in both the lateral and longitudinal directions for the assembly of the lifting device 100 and the bridge cap 110. As described in greater detail below, the cable engaging support 150*b* is shown extending offset from the upper beam 160, positioned above the center of gravity in both the lateral and longitudinal directions for the lifting device 100 in the absence of the bridge cap 110. In embodiments of the lifting device 100 configured to support different lengths of bridge caps 110, it may be appreciated that the cable engaging support 150*a* may be adjustable in its position along the upper beam 160. Adjustment of the position of the cable engaging support 150*a* may be facilitated by any appropriate mechanism, including but not limited to being bolted to one or more of a plurality of adjustment apertures extending along the upper beam 160.

It may be appreciated that in some embodiments a length of the lower beam 220, and the positioning of the beam cap 110 when coupled thereto, may assist in balancing the lifting device 100 when supporting the beam cap 110. Such positioning of the cap supports 230, the cable engaging supports 150, the respective lengths of the upper beam 160 and the lower beam 220, and other weighting considerations may therefore generally be configured in some embodiments to mitigate a tendency for one side of the bridge cap 110 to tip to a lower angle than the opposite side of the bridge cap 110, increasing difficulty in its placement onto the columns. Regardless of the positioning of the cable engaging supports 150, where the upper beam 160 is generally aligned with the upper side-beam 190 and the lower side-beam 200, the connection of the lower side-beam 200 to the lower beam 220 may facilitate an offset therebetween. In other embodiments, the lower beam 220 may be generally aligned with the upper side-beam 190 and the lower side-beam 200, such that an offset may be established between the upper side-beam 190 and the upper beam 160. In still other embodiments, an offset may be established between the upper side-beam 190 and the lower side-beam 200. Other configurations are also possible that establish both a vertical and horizontal offset of the upper beam 160 and the lower beam 220, as they extend generally parallel to the orientation of the bridge cap 110.

In the illustrated embodiment, the lower side-beam 200 is coupled to the lower beam 220 by an offset support assembly 270, configured to support the entirety of the weight of the beam 220, the cap supports 230, the beam cap 110, and all appurtenant mounting structures, and transmit the force thereof onto the lower side-beam 200. In the illustrated embodiment, the offset support assembly 270 includes an upper plate 280*a* that engages the top 220*a* of the lower beam 220, and a lower plate 280*b* that engages the bottom 220*b* of the lower beam 220. While in some embodiments the upper plate 280*a* and the lower plate 280*b* are welded to the lower beam 220, bolts, fasteners, or other connections may additionally or alternatively be provided to facilitate the securing thereof. Furthermore, in some embodiments, such as that illustrated, a pipe 290 extends between the upper plate 280*a* and the lower plate 280*b*, and engages the cap engaging side 220*d* of the lower beam 220. While in some embodiments the pipe 290 is welded to the cap engaging side 220*d*, the pipe 290 may additionally or alternatively partially extend into the lower beam 220, further distributing forces acting on the lower beam 220 across the offset support assembly 270. In an embodiment, the pipe 290 may be welded to both the upper plate 280*a* and the lower plate 280*b*. It may be appreciated that the curved shape of the pipe 290 is generally resistant to torsion, which may resist against the lower beam 200 pivoting relative to the upper beam 160 at the offset support assembly 270. Additionally, the upper plate 280*a* and the lower plate 280*b* coupled together by the pipe 290, and by additional structures, as described below, may generally prevent bending between the lower beam 220 and the lower side-beam 200 at the offset support assembly 270.

In some embodiments, stiffening plates 300 may be positioned between the upper plate 280*a* and the lower plate 280*b*, and may provide further rigidity for the offset support assembly 270. In embodiments of the offset support assembly 270 containing the pipe 290, the pipe 290 may extend through the stiffening plates 300. In an embodiment, the stiffening plates 300 may be welded to both the pipe 290 and to the upper plate 280*a* and the lower plate 280*b*. In alternative embodiments, separate pipes 290 may be secured between the cap engaging side 220*d* of the lower beam 220 and an adjacent stiffening plate 300, between sets of stiffening plates 300, and/or to a stiffening plate 300 furthest from the cap engaging side 220*d* of the lower beam 220.

In some embodiments, including the illustrated embodiment, a mounting between the offset support assembly 270 and the lower side-beam 200 is reversible, so that the lower beam 200 may selectively extend along either the longitudinal side 260*a* (e.g., a left-handed engagement, as shown), or may be flipped so as to extend along the longitudinal side 260*b* (e.g., a right-handed engagement). In the illustrated embodiment, an engagement plate 305 is provided, associated with the lower side-beam 200, which may alternatively be mounted to the so-called upper plate 280*a* to create the left-handed engagement, or may be mounted to the so-called lower plate 280*b* to create the right-handed engagement. In such an embodiment, the position of the lower beam 220 would be offset from the upper beam 160 in an opposite direction, changing the center of gravity for the lifting device 100. Accordingly, the cable engaging support 150*c* is illustrated extending offset from the upper beam 160 opposite to the cable engaging support 150*b*, facilitating a balanced lifting support for the dead weight of the lifting device 100 alone, when the configuration has been switched from the left-handed engagement to the right-handed engagement.

As shown in FIG. 1, in an embodiment, support bolts 310 may couple the engagement plate 305 to the offset support assembly 270. In the illustrated embodiment, the support bolts 310 extend through both the engagement plate 305 and the offset support assembly 270, further distributing the load of the lower beam 220 and the bridge cap 110 (and appurtenant structures) through the offset support assembly 270. Additionally, in some embodiments several of the support bolts 310 may extend through the pipe 290. The number of support bolts 310 utilized in the offset support assembly 270 may vary across embodiments, and may depend on the typical load carried therewith. As shown in the illustrated embodiment, in some embodiments additional bolts may be positioned proximal to the bridge cap 110, so as to provide further support for the weight of the bridge cap 110. While in the illustrated embodiment the support bolts 310 are long bolts that extend through the engagement plate 305 as well as both the lower plate 280*b* and the upper plate 280*a*, in other embodiments shorter bolts may be utilized, that connect the engagement plate 305 to the upper plate 280*a* in the left-handed engagement, or the lower plate 280*b* in the right-handed engagement. As shown, the support bolts 310 are secured by nuts 320. Any other appropriate securing mechanism may be utilized to securely couple the offset support assembly 270 to the lower side-bracket 200, to distribute the weight of the bridge cap 110 to the upper beam 160.

In the illustrated embodiment, the lower side-beam 200 is secured to the engagement plate 305, and indirectly to the offset support assembly 270, through coupling members 330, positioned on opposite long faces of the lower side-beam 200. In an embodiment, where the engagement is not reversible between the left-handed engagement and the right-handed engagement, the coupling members 330 may be welded directly between the lower side-beam 200 as well as to the upper plate 280*a*. In some reversible embodiments, the coupling members 330 may be bent or otherwise multi-faceted, so as to have a face that engages the lower side-beam 200 and a face that engages either the upper plate 280*a* or the lower plate 280*b* depending on the reversible configuration. In some such embodiments, the support bolts 310 may extend through the face engaging the upper plate 280*a*, to provide left-handed engagement between the offset support assembly 270 and the lower side-beam 200, or may extend through the face engaging the lower plate 280*b*, to provide right-handed engagement.

As indicated above, while in some embodiments the upper side-beam 190 and the lower side-beam 200 may be replaced by a common side-beam, in the illustrated embodiment the upper side-beam 190 and the lower side-beam 200 are selectively coupled to one another. In particular, in the illustrated embodiment the upper side-beam 190 includes therein a pair of apertures 340 extending therethrough, configured to receive therein an associated pair of coupling bolts 350. In some embodiments, the apertures 340 may also extend through a pair of reinforcement plates 360 (only one of which is visible in FIG. 1) which may be welded or otherwise secured to opposing sides of the upper side-beam 190. It may be appreciated that in other embodiments, additional or fewer apertures 340, configured to receive a corresponding number of coupling bolts 350, may be formed in the upper side-beam 190 (and the reinforcement plate 360).

A coupling member 370 may be fixed relative the lower side-beam 200, and may contain associated apertures 380 configured to selectively align with corresponding ones of the apertures 340 in the upper side-beam 190, so that the coupling bolts 350 may extend through both the coupling member 370 and the upper side-beam 190, to fix the upper side-beam 190 relative to the lower side-beam 200. While in some embodiments the coupling member 370 may be fixed to the lower side-beam 200 via additional bolts, other securing mechanisms are additionally or alternatively possible. For example, in the illustrated embodiment, a lower portion of the coupling member 370 is welded to a pair of reinforcement plates 390 (only one of which is visible in the view of FIG. 1). The reinforcement plates 390 themselves are welded to opposing sides of the lower side-beam 200, and reinforce the coupling portion of the lower side-beam 200. While in the illustrated embodiment, the coupling member 370 is fixedly coupled to the lower side-beam 200, so that the upper side-beam 190 may be selectively coupled thereto, in other embodiments, the configuration may be reversed, such that the coupling member 370 is fixedly coupled to the upper beam 190, so that the lower side-beam 200 may be selectively coupled thereto.

In the illustrated embodiment, the coupling member 370 includes a first coupling plate 370*a* and a second coupling plate 370*b*, configured to surround and extend above the lower side-plate 200, and form a space configured to receive the upper side-plate 190 (and the reinforcement plates 360 secured thereto). As shown, in an embodiment, the first coupling plate 370*a* and the second coupling plate 370*b* may be joined by an intermediate coupling plate 370*c*, which may be integrally formed with the first coupling plate 370*a* and the second coupling plate 370*b*, or may be secured thereto (e.g., via welds), to form a generally U-shaped space. As shown, in an embodiment the intermediate coupling plate 370*c* may be positioned so as to facilitate disengagement of the upper bracket assembly 130 from the lower bracket assembly 140 once the bridge cap 110 has been positioned on the columns, as described in greater detail below. Additionally, the intermediate coupling plate 370*c* may be positioned so as to provide additional support to the joint between the upper bracket assembly 130 and the lower bracket assembly 140, such as being positioned at a side of the first coupling plate 370*a* and the second coupling plate 370*b* proximal to the bridge cap 110, which may buttress against a bending force at the coupling member 370 from the weight of the bridge cap 110 acting on the lower side-beam 200.

Regardless of the configuration of the coupling member 370, it may be appreciated that once the apertures 340 formed in the upper side-beam 190 of the upper bracket assembly 130 are aligned with the apertures 380 formed in the first coupling plate 370*a* and the second coupling plate 370*b*, the coupling pins 350 may be inserted therethrough. In the illustrated embodiment, the coupling pins 350 may also pass through washer plates 400, and may be secured by bolts 410 that are fixed relative to the coupling pins 350 by associated washers and nuts 420.

In embodiments where the upper bracket assembly 130 and the lower bracket assembly 140 are separable from one another, cable engaging supports may be associated with separately lifting the upper bracket assembly 130 and the lower bracket assembly 140. In the illustrated embodiment, it may be appreciated that the cable engaging support 150*d* may be positioned on the upper bracket assembly 130 above the center of gravity for the upper bracket assembly 130 alone. Additionally, cable engaging supports 425 formed on the lower bracket assembly 140, may facilitate lifting the lower bracket assembly 140 above a center of gravity thereof. It may be appreciated that due to the offset support assembly 270 and the cap supports 230*a* and 230*b* extending from one side of the lower beam 220, a center of gravity for the lower bracket assembly 140 alone may be at a remote position (e.g., spaced from the structure of the lower bracket assembly 140) that would be inconvenient to install a single cable engaging support 425. Accordingly, in the illustrated embodiment the lower bracket assembly 140 includes a cable engaging support 425*a* associated with the offset support assembly 270 or the lower side-beam 200 (or engaging structures therebetween), and a cable engaging support 425*b* associated with the lower beam 220. It may be appreciated that coupling to both the cable engaging support 425*a* and the cable engaging support 425*b* may allow stable and balanced support of the lower bracket assembly 140 alone. As shown, in an embodiment with reversible left-handed and right-handed engagements, a cable engaging support 425*c* may be positioned opposite to the cable engaging support 425*b*, so to allow for lifting support of the lower bracket assembly 140 alone when in the right-handed engagement configuration. In the illustrated embodiment, the cable engaging support 425*a* is mounted to (e.g., welded to) an associated one of the coupling members 330, so as to be utilized with the cable engaging support 425*b* (as the lower bracket assembly 140 is in the left-handed engagement configuration). It may be appreciated that an additional cable engaging support 425*a* (obscured in FIG. 1) may be mounted to the other of the coupling members 330, so as to be utilized with the cable engaging support 425*c* when the lower bracket assembly 140 is in the right-handed engagement configuration. In some embodiments a common cable engaging support 425*a* for the offset support assembly 270 may be positioned thereon, while the cable engaging supports 425*a* and 425*b* may be positioned on the lower side-beam 200 so as to allow for support of the lower bracket assembly 140 by the common cable engaging support 425*a*, and either of the cable engaging supports 425*a* and 425*b*, above the center of gravity of the lower bracket assembly 140 in either the left-handed engagement or right-handed engagement configurations respectively. In other embodiments, any other positioning or configuration of one or more cable engaging supports 425 associated with the lower bracket assembly 140 (including but not limited to being formed associated with either the lower side-beam 200, the engagement plate 305, or appurtenant structures) may additionally or alternatively be utilized.

It may be appreciated that the construction and configuration of the components of the lifting device 100 may vary across embodiments, and may be selected so as to support differing weights of the bridge cap 110. It may be appreciated that the bridge cap 110 may also be of various constructions or configurations, which may alter the weight thereof. For example, the bridge cap 110 in some cases may be a precast concrete pile cap, which may contain reinforcement of steel or another appropriate material. In one non-limiting embodiment, the bridge cap 110 may be approximately 15' long, 3' wide, and 2' tall, and may weigh approximately 19,700 Lbs. To accommodate such sizes and weights of the bridge cap 110, the lifting device 100 may similarly be formed of durable materials. For example, in an embodiment, the components of the lifting device 100 may be formed from steel, or other similarly strong metals. In some embodiments, one or more of the upper beam 160, the upper side-beam 190, the lower side-beam 200 and the lower beam 220, may be formed of 20×8 tube steel, which may have a ½" thick wall. Other sizes are also possible. For example, in some embodiments the one or more of the upper beam 160, the upper side-beam 190, the lower side-beam 200 and the lower beam 220, may be formed of 20×12 tube steel, and may have either a ½" or a ⅜" thick wall. It may be appreciated that other configurations are also possible. For example, in an embodiment, one or more of the upper beam 160, the upper side-beam 190, the lower side-beam 200 and the lower beam 220, may be formed of W24×68 steel (having an I-beam configuration), and may have a plate (e.g., a ½" plate) welded to connect the flanges on at least one side of the I-beam to form a tube shape. In some non-limiting embodiments, to support the force of the bridge cap 110, the bolts or other fasteners that extend through the apertures 250 into the sides 120*a* and 120*b* of the bridge cap 110 may be approximately greater than 6" long (including, for example, being approximately 7¼" long, being 13" long, or being 2' long), and may be approximately greater than 1" in diameter (including, for example, 1¼" in diameter). In an embodiment, the bolts or other fasteners may correspond to the A325 standard.

Figure 2:
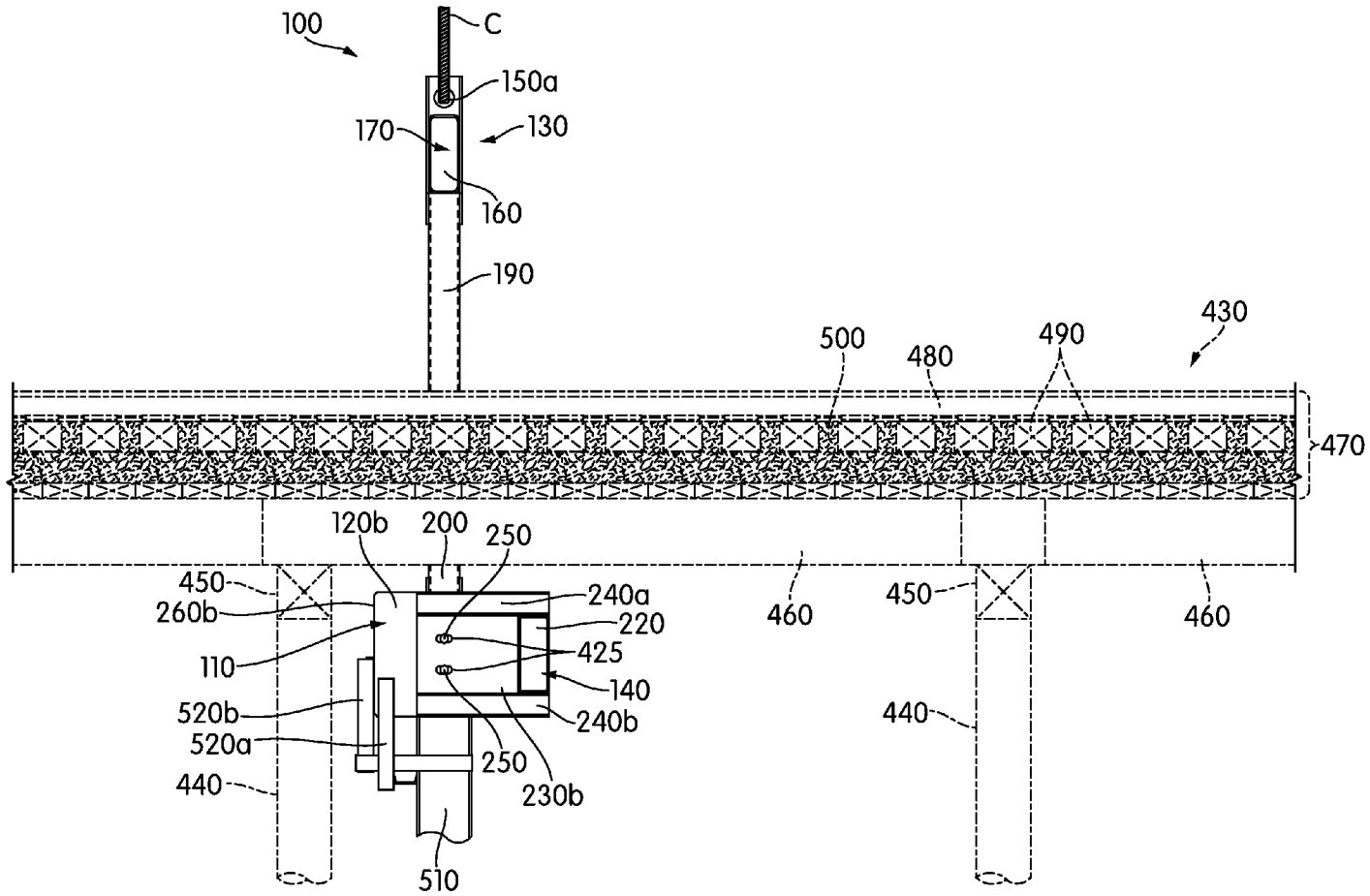
FIG. 2 illustrates a front view of the lifting device of FIG. 1 installing the bridge cap onto new support columns under a deck of an existing bridge.
Figure 3:
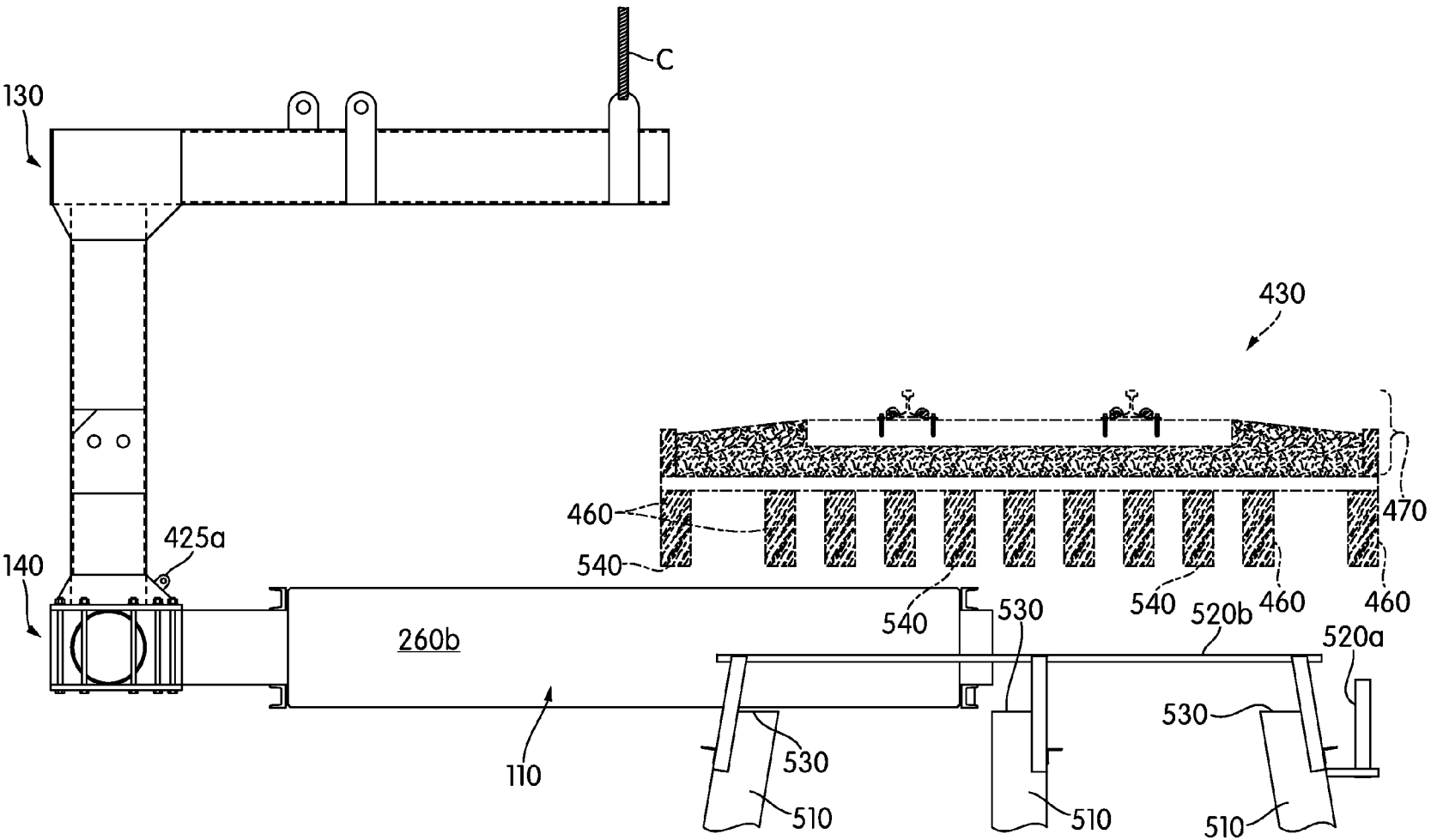
FIG. 3 illustrates a sectional view of the existing bridge of FIG. 2, showing the lifting device supporting the bridge cap as it is in the process of being lifted into place on the new support columns.
Figure 4:
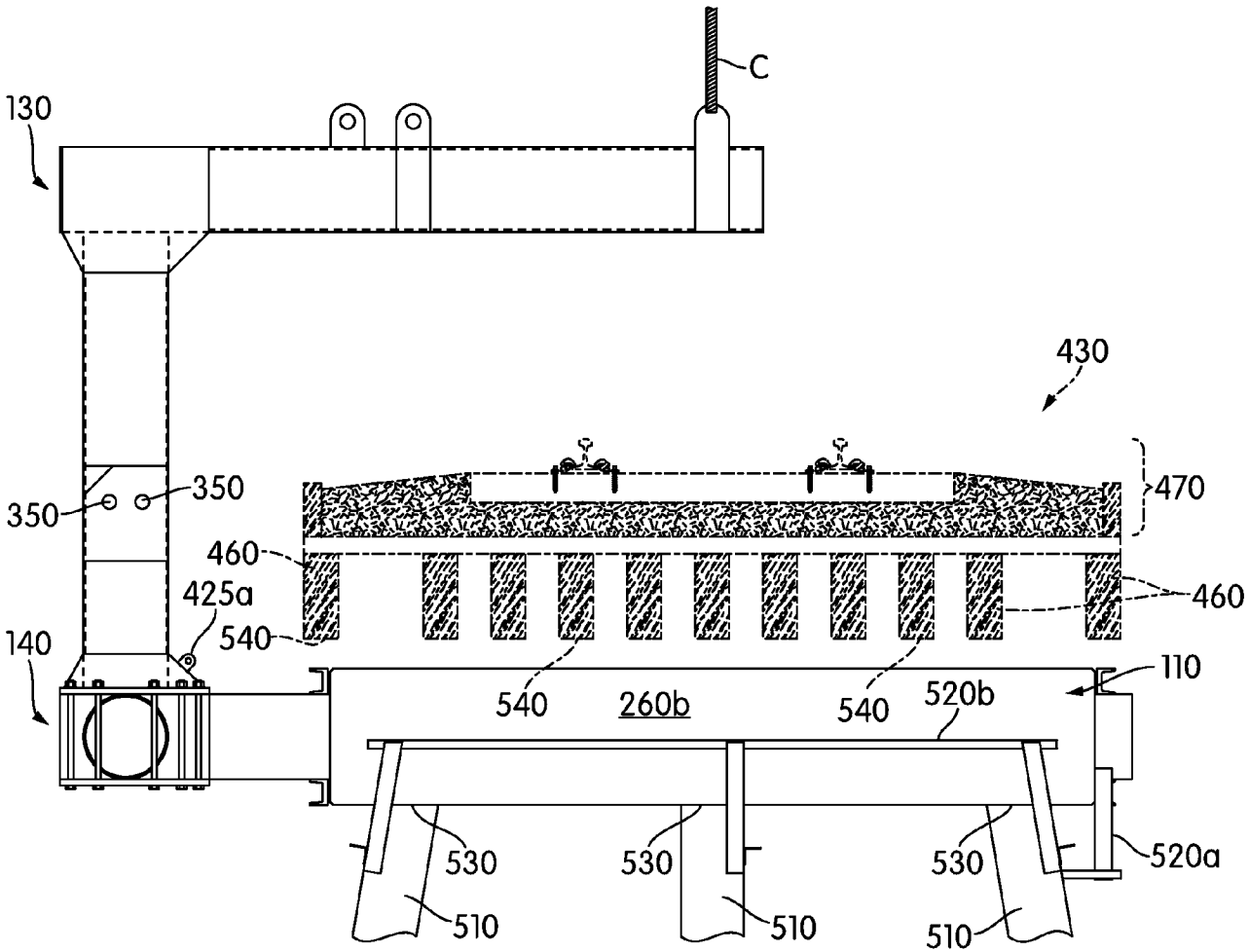
FIG. 4 illustrates a sectional view similar to that of FIG. 3, once the bridge cap has been lifted into its final position on the new support columns.

Other components of the lifting device 100 may be similarly sized to form a durable apparatus sufficient to support the bridge cap 110. For example, in an embodiment, the pipe 290 of the offset support assembly 270 may comprise a 20" diameter×1'-4½" long pipe, Also, in an embodiment, the upper plate 280*a* and the lower plate 280*b* may each comprise PL1(⅛)×35¼×3'-0½" steel. In an embodiment the stiffening plates 300 may each be approximately ¾" thick. Additionally, in an embodiment, the coupling members 330 may each comprise PL ½×6×2'-1" steel. Furthermore, in an embodiment, each of the support bolts 310 may comprise 1" diameter×18" long bolts, which may include A325 standard bolts, FIGS. 2-4 illustrate the operation of an embodiment of the lifting device 100 in installing a bridge cap 110. As shown, the lifting device 100 is supported by a cable C of a crane (not shown), which supports the weight of the lifting device 100 and the bridge cap 110. FIG. 2 shows that the bridge cap 110 may be secured to the cap supports 230 of the lifting device 100 by bolts 425, which extend through the apertures 250 of the cap supports 230, into the bridge cap 110. The view of FIG. 2 faces the free end 170 of the upper beam 160 and the cap support 230*b*, between which is an open space sized to receive an existing bridge structure 430. As shown in the example of FIG. 2, the existing bridge structure 430 includes old columns 440 and old bridge caps 450 that support the beams 460 and deck 470. In an embodiment, clearance of the upper beam 160 above an upper surface of the bridge deck may be approximately greater than 3 feet, while clearance of the bridge cap 110 and the beams 460 may be less, including, for example, being approximately less than a foot.

It may be appreciated that the existing bridge structure 430 illustrated in FIG. 2 is a rail road bridge, and as such, the deck 470 includes rails 480 and ties 490, surrounded by track ballast 500. Conventionally, the ties 490 are constructed of wood, while the track ballast 500 is formed of crushed stone. Older existing bridge structures 430 may also generally be constructed of wood, however are typically being replaced by reinforced concrete structures. It may be appreciated that to install the bridge cap 110, new columns 510 may be driven into the ground, positioned between adjacent sets of the old columns 440. As shown, in some embodiments guide members 520*a*-*b* may be mounted to one of the new columns 510, so as to facilitate positioning the bridge cap 110 relative to the new columns 510. Specifically, in the view of FIG. 2, a guide member 520*a* is configured to assist in positioning the end 120*b* of the bridge cap 110 (serving as a stop), while the guide member 520*b* is configured to assist in positioning the side 260*b* of the bridge cap 110.

FIGS. 3 and 4 illustrate a different view of the process of using the lifting device 100 to lift the bridge cap 110 onto the new columns 510 that have been installed underneath the existing bridge structure 430. Specifically, the view of FIGS. 3 and 4 may be along a section of the existing bridge structure 430 adjacent to the new columns 510. As shown in FIG. 3, the guide members 520*a*-*b* may be mounted to the new columns 510, and may be aligned to guide a precise placement of the bridge cap 110 during installation with the lifting device 100. While the bridge deck 470 and beams 460 of the existing bride structure 430 are being supported by the old columns 440 and old bridge caps 450, the lifting device 100 may be hoisted by the cable C generally horizontally between top surfaces 530 of the new columns 510 and bottom surfaces 540 of the bridge beams 460. The movement of the bridge cap 110 into place may continue until the bridge cap 110 is in position, which may be guided by the guide members 520*a*-*b*. In some embodiments, installation of the bridge cap 110 may include the use of guide cables pulled by workers, while support and movement is provided by the crane lifting the lifting device 100 via the cable C. In various embodiments, cable supports for the guide cables may be provided on the lower bracket assembly 140. For example, in the illustrated embodiment, the cable engaging supports 425 may be utilized as such anchors for guide cables. Other guide cable supports may be positioned elsewhere on the lower bracket assembly 140, the bridge cap 110, or elsewhere on the lifting device 100, to allow the workers to assist in movement of the bridge cap 110.

As shown in FIG. 4, once the bridge cap 110 has been positioned above the new columns 510, the crane operator may lower the bridge cap 110 onto the new columns 510, releasing any tension on the bolts 425. The bridge cap 110 may then be secured onto the new columns 510, such as by interlocking onto the new columns 510, being welded or cemented thereon, or by any other appropriate mechanism. After the tension on the bolts 425 is released, the bolts 425 may also be removed by pulling them out of the bridge cap 110, disengaging the connection between the lifting device 100 and the bridge cap 110.

Figure 5:
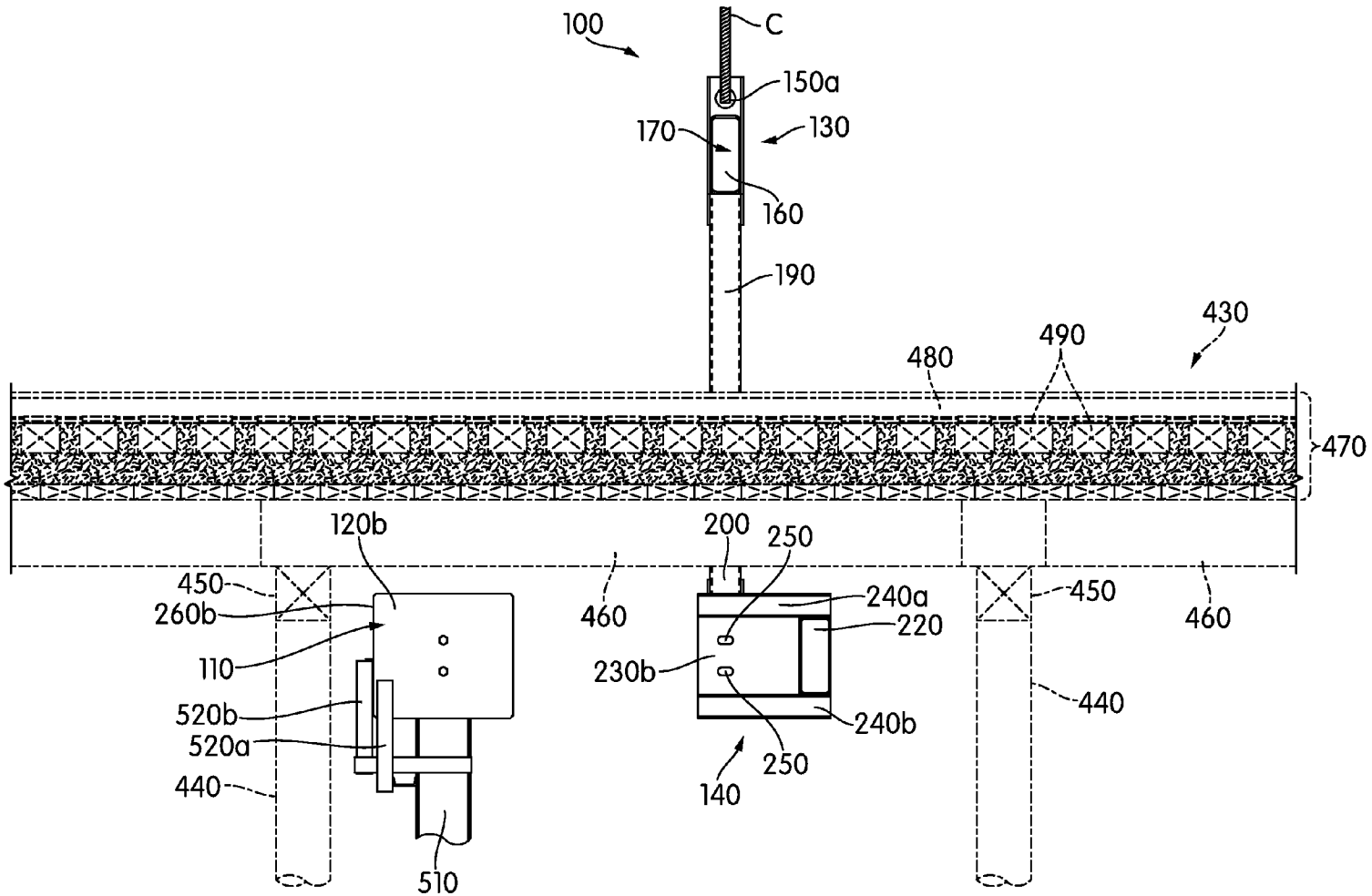
FIG. 5 illustrates a front view similar to that of FIG. 2, after the bridge cap has been lifted into its final position and the lifting device has been separated therefrom, to show removal of the lifting device.

Once the bridge cap 110 is disengaged from the lifting device 100, the lifting device 100 may be removed. As shown in FIG. 5, in an embodiment this removal may include laterally moving the lifting device 100 by increasing a spacing between the lower beam 220 and the bridge cap 110, until the cap supports 230 are no longer aligned with the bridge cap 110 (and the new columns 510). The lifting device 100 may then be moved in a direction so that the lower beam 220 and the upper beam 160 no longer surround the bridge deck 470 and the beams 460 (e.g., in the direction of the view of FIG. 5), at which point the lifting device 100 may be moved to be secured to another bridge cap for further installation, or may be removed entirely if the no longer needed. It may be appreciated that in some embodiments, removal of the lifting device 100 may include disengaging the upper bracket assembly 130 from the lower bracket assembly 140 (e.g., by disengaging the bolts 350). Such separation may be preferred where the old bridge columns 440 and old bridge caps 450 are narrowly spaced from one another, or where clearance behind the lower beam 220 in a direction away from the bridge cap 110 is otherwise limited. In some embodiments, separate rigging to support at least the weight of the lower bracket assembly 140 once the bridge cap 110 is no longer coupled thereto may be established, which may make the cable C, coupled to the lifting power of the crane, otherwise redundant.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the objects of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A lifting device configured to support a bridge cap when lifting the bridge cap onto columns under a bridge deck, the lifting device comprising:

an upper bracket arm configured to extend over an upper surface of the bridge deck;

a lower bracket arm configured to extend under a bottom surface of the bridge deck, and to selectively engage the bridge cap; and a side bracket portion connecting the lower bracket arm and the upper bracket arm, the side bracket portion configured to transmit a force associated with a weight of the bridge cap to the upper bracket arm;

wherein the upper bracket arm, the lower bracket arm, and the side bracket portion are configured to define an open space extending from free ends of the upper bracket arm and the lower bracket arm to the side bracket portion, the open space configured to receive the bridge deck when the lifting device is supporting the bridge cap as the bridge cap is being lifted onto the columns.

2. The lifting device of claim 1, wherein the lower bracket arm includes a first cap support member configured to support a first end of the bridge cap.

3. The lifting device of claim 2, wherein the first cap support member extends along the first end, and is selectively secured to the first end.

4. The lifting device of claim 3, wherein the first cap support member is selectively secured to the first end by one or more bolts extending through the first cap support member into the first end of the bridge cap.

5. The lifting device of claim 3, wherein the first cap support member is selectively secured to the first end by a welding between the first cap support member and a first weld plate secured into the first end of the bridge cap.

6. The lifting device of claim 1, wherein the side bracket portion includes an upper side bracket portion associated with the upper bracket arm, and a lower side bracket portion associated with the lower bracket arm, wherein the upper side bracket portion and the lower side bracket portion are selectively coupled together.

7. The lifting device of claim 1 wherein the upper bracket arm includes a cable support configured to couple to a cable of a crane, so that the crane may support the lifting device.

8. The lifting device of claim 7, wherein the cable support is positioned on the upper bracket arm above a center of gravity of the lifting device and the bridge cap.

9. The lifting device of claim 1, wherein, when the lifting device is supporting the bridge cap, the upper bracket arm extends generally above the bridge cap, while the lower bracket arm extends generally alongside the bridge cap, such that the upper bracket arm and the lower bracket arm are offset from one another both vertically and horizontally.

10. The lifting device of claim 9, wherein the side bracket portion is offset from the lower bracket arm.

11. The lifting device of claim 10, wherein the side bracket portion is aligned with the upper bracket arm.

12. The lifting device of claim 1, further comprising a coupling plate welded to both the upper bracket arm and the side bracket portion.

13. The lifting device of claim 1, wherein the lower bracket arm comprises 20×8 tube steel configured to extend along a length of the bridge cap.

14. The lifting device of claim 1, wherein the bridge cap is approximately 15 feet in length, wherein the lower bracket arm is greater than 15 feet in length.

15. An assembly comprising:

a bridge having a bridge deck;

a support column spaced beneath the bridge deck, the support column configured to receive a bridge cap thereon; and a lifting device comprising:

an upper bracket arm configured to extend over an upper surface of the bridge deck;

a lower bracket arm configured to extend under a bottom surface of the bridge deck, and to selectively engage the bridge cap; and a side bracket portion connecting the lower bracket arm and the upper bracket arm, the side bracket portion configured to transmit a force associated with a weight of the bridge cap to the upper bracket arm;

wherein the upper bracket arm, the lower bracket arm, and the side bracket portion are configured to define an open space extending from free ends of the upper bracket arm and the lower bracket arm to the side bracket portion, the open space configured to selectively receive the bridge deck when the lifting device is lifting the bridge deck onto the support column.

* * * * *